United States Patent [19]

Pfeifer

[11] 4,319,731

[45] Mar. 16, 1982

[54] MERCHANDISE DISPLAY ASSEMBLY

[75] Inventor: William Pfeifer, Springdale, Pa.

[73] Assignee: Armstrong Store Fixture Corporation, Pittsburgh, Pa.

[21] Appl. No.: 205,654

[22] Filed: Nov. 10, 1980

Related U.S. Application Data

[63] Continuation-in-part of Ser. No. 55,828, Jul. 9, 1979.

[51] Int. Cl.[3] ..... G09F 3/18

[52] U.S. Cl. ..... 248/223.4; 248/220.4; 248/289.3; 40/16.4

[58] Field of Search ..... 248/220.3, 220.4, 221.1, 248/221.2, 222.2, 223.4, 224.2, 542, 73; 211/57.1, 59.1; 40/16.4

[56] References Cited

U.S. PATENT DOCUMENTS

| | | | |
|---|---|---|---|
| 1,033,915 | 7/1912 | McDonald | 211/57.1 X |
| 2,291,966 | 8/1942 | Joseph | 248/215 |
| 2,665,869 | 1/1954 | Samuels | 248/226.5 |
| 2,727,272 | 12/1955 | Hankin et al. | 248/223.4 X |
| 3,525,493 | 8/1970 | Crietzberg et al. | 248/224.2 |
| 3,645,485 | 2/1972 | Gold | 211/59.1 X |
| 3,897,926 | 8/1975 | Silver | 248/221.1 |
| 3,976,201 | 8/1976 | Hodgson | 248/220.4 |
| 4,246,710 | 1/1981 | Mixer | 211/57.1 |

*Primary Examiner*—William H. Schultz

*Attorney, Agent, or Firm*—Parmelee, Miller, Welsh & Kratz

[57] ABSTRACT

An improved information display assembly with a cantilevered arm and a detachable means for displaying indicia at the free end of the arm is disclosed. The free end of the arm has a horizontal member extending therefrom at a right angle. There is a transverse groove on the upper surface of the arm. This groove is on the free end of the arm and is parallel with the horizontal member. The detachable display means mounts onto this horizontal member and arm. This display means has a planar member with a front face upon which indicia is displayed and a rear face from which extend two parallel arms with a flange extending from the free end of the upper arm. When the display means is mounted on the cantilevered arm, the parallel arms are contiguous with the upper and lower surfaces of the cantilevered arm and horizontal member and the flange engages the transverse groove.

6 Claims, 4 Drawing Figures

MERCHANDISE DISPLAY ASSEMBLY

CROSS-REFERENCE TO RELATED APPLICATIONS

This application is a continuation-in-part of my earlier filed and pending application, "Merchandise Hanger Assembly", Ser. No. 55,828 filed on July 9, 1979. This application discloses a vertically mounted bracket supporting two cantilevered arms. One arm displays the merchandise while the other arm has a label support means which bears information relevant to the merchandise. The present invention improves the assembly by providing a tag holder which is detachable from the shaft.

BACKGROUND OF THE INVENTION

1. Field of the Invention

This invention relates to information display devices such as the type used in a hanger bracket assembly. This assembly has a bracket which supports a cantilevered arm upon which carded merchandise is hung and a cantilevered label holder upon which indicia relating to the merchandise is placed. More particularly, this invention relates to a means for removably securing a tag holding device to a cantilevered arm by means of a depending flange and transverse groove.

2. Prior Art

It has been common practice to display carded merchandise by hanging it from horizontal hangers. It has also been found useful to provide tag holders upon which sales or inventory information relating to the carded merchandise can be placed. These tag holders have taken on a variety of configurations, each of which requires a different method for securing the label holder to the display. U.S. Pat. Nos. 2,626,061 and 2,802,576 provide that labels be permanently affixed to the display. The use of removable tag holders has also been known, U.S. Pat. No. 3,091,875 teaches the use of a spring like wire device which can be mounted on a merchandise display. This device can extend and enlarge the display tag area. U.S. Pat. No. 4,140,224 is another type of display tag. It describes a shelf protector which carries at its outer edge a label support assembly that consists of a channel which interlocks with a protrusion. The protrusion has a semi-oval cross-sectional shape and a locking channel formed of curved arms which surround the periphery of the locking protrusions.

SUMMARY OF THE INVENTION

In accordance with the invention, an information display assembly has a cantilevered arm and a means for displaying information removably mounted at the free end of the arm. The information display means or label holder is a planar member with a front face upon which relevant merchandising information is placed and a rear face from which upper and lower parallel arms extend perpendicularly. A depending flange extends from the free end of one of the parallel arms. The cantilevered arm has an elongated shaft portion at one end, a base portion at the other end and an intermediate portion thereinbetween which offsets the base portion from the shaft. A horizontal member extends at approximately a right angle from the free end of the shaft portion. Additionally, an offset with a bearing surface may project from the horizontal member on a plane defined by said shaft and said horizontal member. The cantilevered arm may be manufactured from a length of round wire or from a wire of noncircular cross-section. In either embodiment the shaft has an upper and lower surface and at least one of the surfaces is provided with a transverse groove adjacent to and parallel with the horizontal member.

When properly mounted, the horizontal member rests flush against the rear face of the label holder between the parallel arms. The arms straddle the horizontal member and the flange extending from the arm engages the transverse groove. This relationship inhibits movement of the label holder relative to the cantilevered arm.

Preferably, the label holder is continuously molded from a resilient material and cut to the desired length. The invention is designed for separate use or for incorporation with the merchandise hanger assembly disclosed in my previous application. Briefly, the hanger bracket assembly comprises a merchandise hanger formed from an elongated shank with a depending base portion, an information support member formed from an elongated shaft with a depending base portion at one end and an information display means at the opposite end, and a base member into which the depending base portions are mounted. The base portion is additionally provided with means by which it can be secured to a wall, partition or the like.

It is an object of this invention to provide a means for removably securing display information label holders to a cantilevered shaft.

It is another object of this invention to provide a means for securing display information to a merchandise hanger assembly which does not interfere with the normal stocking and removal of carded merchandise.

It is yet another object to provide a label holder which is easily manufactured by a continuous molding process and then cut to the desired length for use with cantilevered shafts.

It is still another object of this invention to provide a simple and quick way to remove label holders from display devices for the revision of marketing information on the labels.

DETAILED DESCRIPTION

Figure 1:
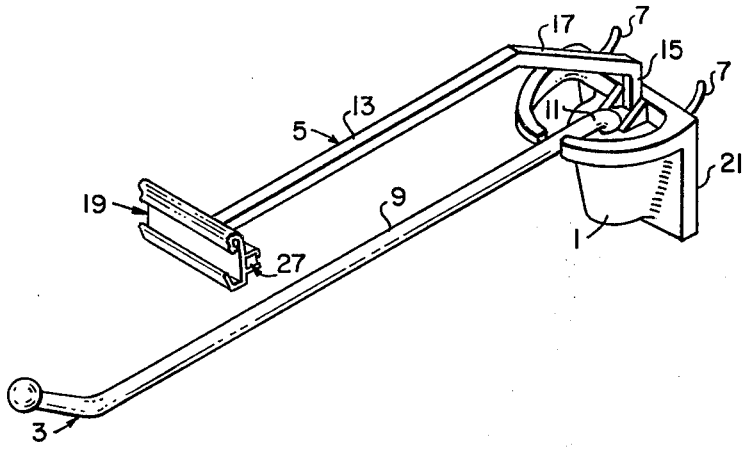
FIG. 1 is a front isometric view of a hanger bracket with a hanger member and label supporting assembly in place.

FIG. 1 illustrates a hanger bracket 1 supporting a pair of cantilevered arms 3 and 5. A pair of laterally spaced lugs 7 extend rearwardly and then upwardly from the upper rear portion of the hanger bracket 1 and provide a means by which the bracket 1 is mounted on a perforated board. The lugs 7 extend through holes in the perforated board and secure the bracket 1 in place. The bracket can, of course, be equipped with various mounting means other than lugs 7 which are provided for illustrative purposes only. The bracket could, for example, include a clip for engaging the edge of a vertical member or means for engaging a vertical post. Cantilevered arm 3 functions as a merchandise hanger member having an elongated shank portion 9 and a base portion 11 depending at substantially a right angle. The cantilevered arm 5 in which is incorporated the features of this invention functions as a label support arm and consists of an elongated shaft 13, a base portion 15 and an intermediate portion 17 which extends forward from the base portion 15 just above the shank 9 of the hanger member and then diagonally upward to the shaft portion 13. The label arm may be manufactured from a length of round wire which is bent or twisted to conform to the features of the arm 5 as previously described, or the arm may be manufactured from a wire of noncircular cross section. While the shaft is shown to be of noncircular cross-section, this is done for illustrative purposes only and is not in any way meant to suggest that one embodiment is superior over the other. The choice of material of manufacture will depend, of course, on a myriad of factors, including availability and cost of the material used. The free end of shaft 13 is fitted with a removable label holder 19 which generally displays various information concerning the merchandise hung from arm 3. While it is possible to provide a label support arm in which the base depends directly from the shaft, the incorporation of the offset intermediate portion allows the bracket to be mounted onto or removed from a perforated board without first detaching the label support arm. With the arrangement as illustrated in FIG. 1, the bracket is installed in the perforated board by holding the bracket with the planar rear surface 21 nearly horizontal and inserting the ends of the lugs 7 into the holes in the perforated board. The bracket is then rotated so that the planar surface 21 rests against the board. The intermediate portion 17 of the arm 5 offsets the arm from the planar surface 21 such that the bracket 1 with both the hanger arm 3 and label support arm 5 installed can be inserted or removed from the perforated board as a unit. Typically, the label support arm 5 will be shorter than and cantilevered over the merchandise support arm 3.

Figure 2:
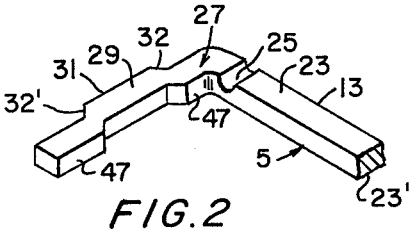
FIG. 2 is a rear isometric partial view of the label holder support arm.

Turning now to FIG. 2, the means by which the tag holder 19 is supported on the arm 5 is clearly shown. The shaft 13 has an upper horizontal surface 23 and a lower horizontal surface 23' with at least one of these surfaces having a transverse groove 25 therein. A support member 27 extends from the free end of the cantilevered arm 5 and is generally horizontal to and perpendicular with the shaft 13. The transverse groove is adjacent to and parallel with the horizontal member or extension 27. Additionally, the extension 27 is formed with an offset 29 which provides a bearing surface 31, and cammed surfaces 32 and 32' extending from the bearing surface to the extension.

Figure 3:
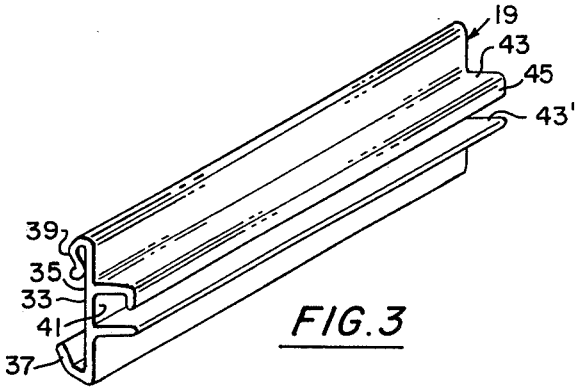
FIG. 3 is a rear isometric view of the label holder.

In FIG. 3, the rear view of a detached label holder 19 shows the means by which the label holder is removably secured to the cantilevered arm 5 and extension 27. The label holder comprises a planar member 33 with a front face 35 upon which various information can be displayed. Labels or the like are held in place by a lower trough 37 and an upper inwardly biased securing member 39. The rear face 41 of the planar member 33 has an upper arm 43 and a lower arm 43' extending substantially perpendicularly therefrom. The arms 43 and 43' may be in a parallel relation or slightly angled toward one another as they extend outwardly from the planar member 33. At least one of the arms 43 and 43' has a flange 45 projecting from its free end and confronting the other arm. Preferably, as illustrated, the flange 45 depends from the upper arm 43 and extends toward yet terminates short of the lower arm 43' at a point about halfway thereinbetween.

Figure 4:
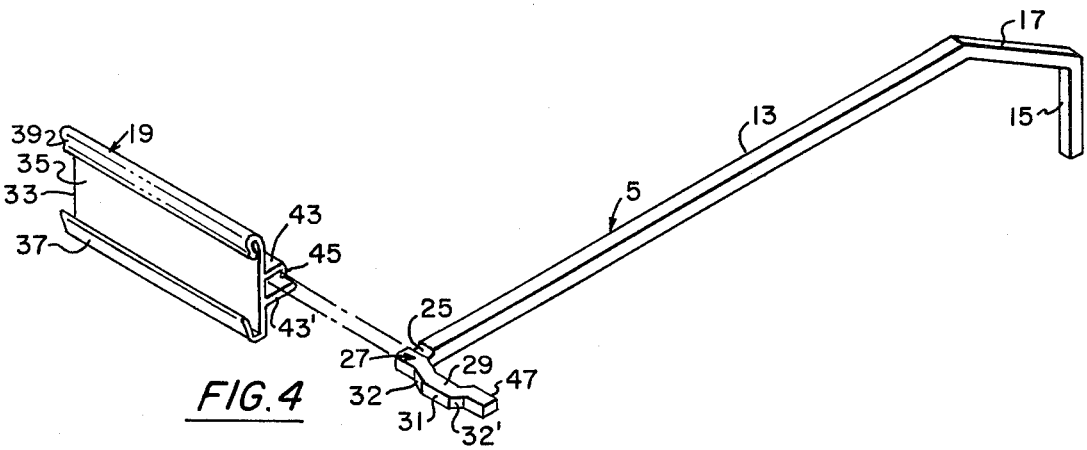
FIG. 4 is an exploded isometric view of the label support member, all in accordance with the teachings of the invention.

The manner in which the label holder 19 is removably attached to the support arm 5 is illustrated in FIG. 4. As indicated, the shaft 13 has an upper and lower horizontal surface at least one of which surfaces has a transverse groove 25 adjacent the extension 27. Preferably, this groove is located on the upper surface 23 and is engaged by the flange 45 of the tag holder 19. While it is possible to provide a flange on both arms 43 and 43' and a traverse groove in both the upper and lower surfaces 23 and 23', the preferred embodiment as illustrated and described offers an effective combination of shaft strength and tag holder stability to the assembly.

The arms 43 and 43' of the label holder 19 are spaced apart no less than the thickness of the label support shaft 13 as measured from the upper horizontal surface 23 to the lower horizontal surface 23'. The length of the arm 43 as measured from the flange 45 to the rear face 41 is no less than the width of the extension 27 including the offset 29. When the label holder 19 is mounted onto the cantilevered shaft 13, the arms 43 and 43' straddle the horizontal surfaces 23 and 23' of the shaft. The depending flange 45 engages the transverse groove 25 and the rear face 47 of the extension 27. The rear face 41 of label holder 19 abuts the bearing surface 31 of the offset 29. This relationship restricts movement of the label holder relative to the cantilevered support member 5 through the friction fit of the components.

The label holder 19 can be mounted onto the support member as follows. The label holder is positioned to the side of the shaft 13 opposite the extension 27 and with the flange 45 aligned with the groove 25. The label holder 19 is laterally slid onto the extension 27 so that the parallel arms 43 and 43' straddle said extension. As the tag holder nears the bearing surface 31 of the offset 29, the cammed surface 32 will guide the lead edge of the tag holder up onto the offset. Ideally, the tag holder 19 will be twice the length of the extension 27 so that when mounted thereon, the shaft 13 is approximately at the center of the label holder 19.

Several variations in manufacture may slightly alter the exact relationship between the label holder 19 and the support member 5. As already indicated, it is possible to use a two flange, two groove configuration. The length of the depending flange may be increased slightly so that when mated with the groove, the arm from which the flange depends may be bowed out away from the horizontal surface of the shaft, thus creating a spring like tension in the arm. A similar result occurs when the arms are angled inwardly toward one another. The support member 5 can be shaped from a single length of round wire which is bent or twisted to form the base, intermediate portion, shaft and extension. The offset can be stamped into the extension and the groove cut or stamped into the shaft.

As described, the invention will provide a label holder which is convenient to use, easy to manufacture and adaptable to my merchandise hanger assembly.

What is claimed is:

1. In an information display assembly of the type including a cantilevered arm and a means for displaying indicia at the free end of the cantilevered arm, the improvement wherein the cantilevered arm comprises: a shaft with at least one transverse groove near the free end of the shaft, and a horizontal member extending at a right angle from the free end of the shaft, parallel with said groove and wherein the means for displaying indicia is removably attached to said shaft and comprises: a planar member having a front face upon which indicia is displayed, a rear face and upper and lower resilient, planar, generally rectangular arms extending transversely from the rear face in generally parallel spaced relationship with a flange at the free end of at least one of the said arms extending toward the other arm, said arms, flange and groove being so dimensioned that when the display means is attached to the cantilevered arm with said planar member generally perpendicular to the axis of said shaft, said upper and lower arms straddle said horizontal member and the shaft, and said flange engages said transverse groove in said shaft with a friction fit and overlaps said horizontal member to secure said display means against rotation about the axis of the cantilevered arm and the axis of the horizontal member and against rotation in the plane containing the cantilevered arm and the horizontal member.

2. The improved information display assembly of claim 2 wherein the shaft of the cantilevered arm includes an upper and lower surface and the transverse groove is in the upper surface of the shaft and said flange depends from the upper arm of the label holder.

3. The improved assembly of claim 1 wherein an offset portion having a bearing surface projects from said horizontal member in the plane defined by said shaft and said horizontal member.

4. The improved assembly of claim 3 wherein the offset portion has a cammed surface extending from the bearing surface of said offset to said horizontal member.

5. The improved assembly of claims 2 or 4 wherein the cantilevered arm is manufactured from a length of round wire defining an upper and lower surface and said transverse groove is in said upper surface.

6. The improved assembly of claim 2 or 4 wherein the shaft is of noncircular cross-section defining an upper and lower surface and said transverse groove is in said upper surface.

* * * * *